United States Patent [19]

Gontowski, Jr.

[11] 4,199,753

[45] Apr. 22, 1980

[54] INTEGRATED CIRCUIT FOR DETECTING CHANGES IN LIGHT INTENSITY

[75] Inventor: Walter S. Gontowski, Jr., Thompson, Conn.

[73] Assignee: Sprague Electric Company, North Adams, Mass.

[21] Appl. No.: 878,045

[22] Filed: Feb. 15, 1978

[51] Int. Cl.[2] ..... G08B 21/00

[52] U.S. Cl. ..... 340/555; 250/211 J; 307/311; 340/692; 340/693; 356/223

[58] Field of Search ..... 340/555, 693, 692; 250/211 J, 214 B; 307/311, 297; 356/223

[56] References Cited

U.S. PATENT DOCUMENTS

| | | | |
|---|---|---|---|
| 3,779,142 | 12/1973 | Yata et al. | 95/10 CE |
| 3,859,519 | 1/1975 | Weischedel | 250/214 B |
| 3,863,239 | 1/1975 | Campman | 340/555 |
| 4,085,411 | 4/1978 | Genesi | 307/311 |

OTHER PUBLICATIONS

Greene, A. B., *Analog Integrated Circuit Design*, pp. 118, 119, 122 & 123, Van Nostran Reinhold Co., New York, 1972.

*Primary Examiner*—Glen R. Swann, III
*Attorney, Agent, or Firm*—Connolly and Hutz

[57] ABSTRACT

An integrated circuit employing a photo-diode activates an alarm when an intruder causes a change in the ambient light patterns by more than about 5% in an area under surveillance. The circuit includes a voltage regulator for supplying a back bias voltage to the photo-diode which voltage is substantially purged of noise that may be superimposed on the main d.c. supply voltage conductors. The regulator circuit includes a modified current-mirror type current source and a $V_{BE}$-multiplier circuit providing a log-log noise transfer function.

8 Claims, 1 Drawing Figure

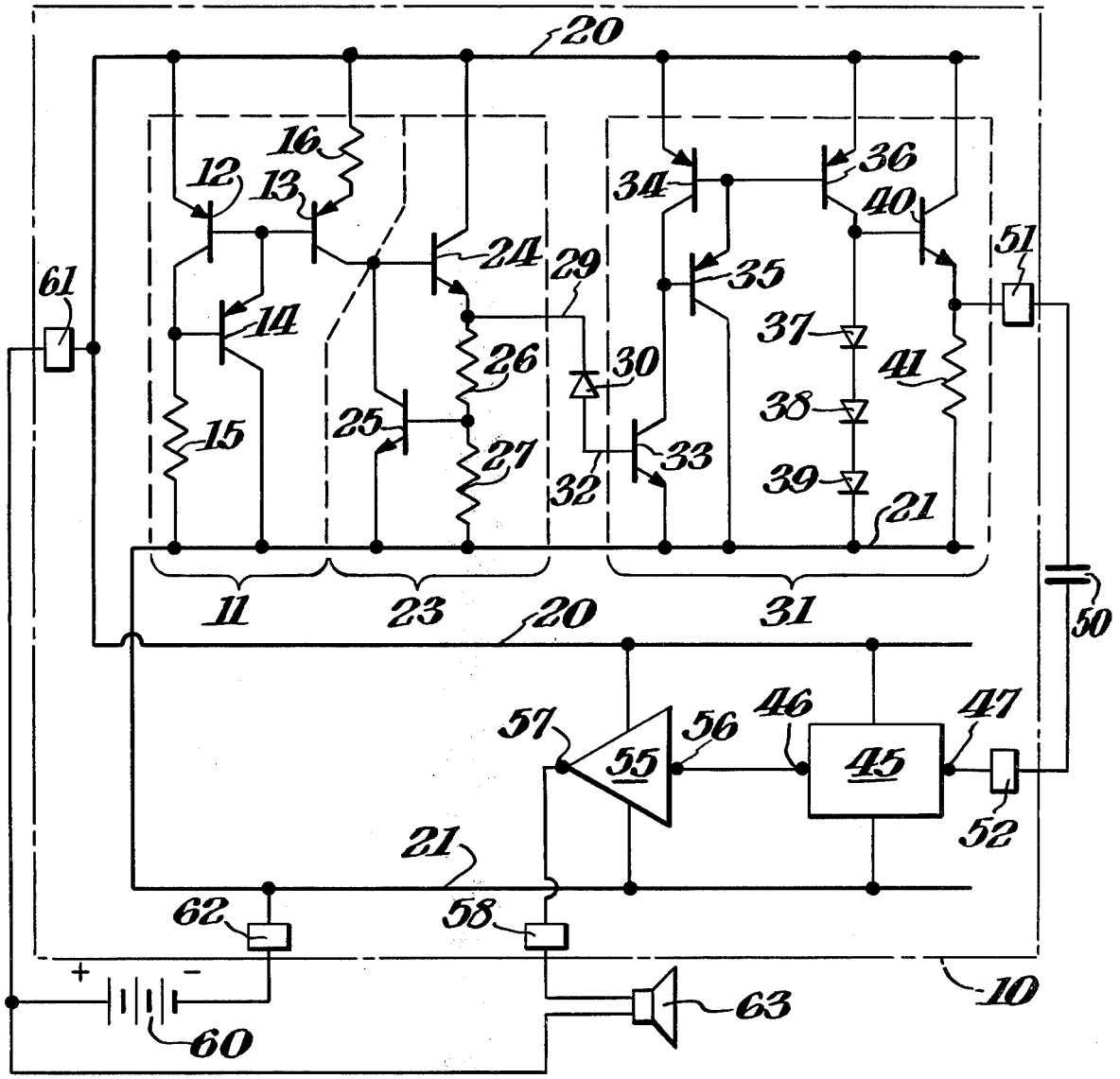
20
16
12
13
24
29
34
36
40
51
61
14
35
37
26
30
41
15
25
27
33
38
32
39
21
11
23
20
31
50
57
56
46
47
55
45
52
21
62
58
10
+
-
60
63

INTEGRATED CIRCUIT FOR DETECTING CHANGES IN LIGHT INTENSITY

BACKGROUND OF THE INVENTION

This invention relates to an integrated circuit for detecting changes in light intensity and more particularly to such an integrated circuit having a noise immune voltage regulator supplying the back bias voltage on a photo-diode.

Intrusion alarms, proximity sensors, and other systems, are known, which systems operate on the principle that a signal is produced when a body moves between a photo-sensor and a fixed source of light causing a reduction or an increase in the absolute intensity of the sensed light. Camera photo-sensors likewise produce a signal that is related to the absolute light level being sensed. Unlike the above noted light sensing systems, it is a change in light level that is of interest here and not the absolute level of light which is to be detected.

A conventional means for light detection is comprised of a photo-diode that produces a current which is proportional to the light being sensed at any instant of time. The photo-diode is typically connected so as to be back-biased between a d.c. voltage buss and the input of a current amplifier. An integrated circuit of this kind is disclosed by Genesi in patent application Ser. No. 677,573 filed Apr. 16, 1976, now U.S. Pat. No. 4,085,411 issued Apr. 18, 1978 and assigned to the same assignee as the present invention.

Fluctuations or noise voltages appearing superimposed on the d.c. voltage supply buss tend to be transmitted directly to the input of the photo-amplifier through the inherent PN junction capacity of the photo-diode. In a photo sensing system responsive only to a change in light level, such noise signals would tend to produce a seriously distorted and false output signal.

This problem is exacerbated when it is additionally required that the sensing system be battery operated and/or have a self-contained relatively high power alarm-signal producing means operable from the same battery power supply. Such alarm-signal means such as flashing lamps, buzzers, etc., typically generate large amplitude noise signals on the aforementioned power buss, and dry battery power sources typically do not provide a low impedance source that would tend to minimize this noise. Noise may also be induced in the power buss by nearby motors, relays or other power handling equipment.

A conventional solution to this kind of problem consists in providing power buss noise isolation filters typically consisting of an impedance inserted in series with the d.c. power buss at the noise sensitive photo sensing circuit plus one or more filter capacitors. Besides the extra expense of such filters, they typically reduce the d.c. voltage supplied to the noise sensitive circuits requiring in turn an increase in the battery voltage which leads to additional expense.

It is an object of this invention to provide a photo sensing integrated circuit that is responsive only to changes in light intensity and that includes an integrated supply voltage regulator for isolating the photo sensor from noise that may be superimposed on the d.c. supply voltage.

It is a further object of this invention to provide such an integrated circuit that is operable from a relatively low voltage d.c. source (e.g. 2.5 volts).

It is a further object of this invention to provide such an integrated circuit including an integrated high power alarm generating means which entire integrated circuit is powered from a common d.c. voltage source.

SUMMARY OF THE INVENTION

An integrated circuit for detecting changes in light intensity is comprised of a silicon substrate, a photo-diode, a pair of d.c. power supply conductors, a current amplifier and a voltage regulator means. Also included is an a.c. coupling means that is connected in series with the signal path through the amplifier selectively passing only varying components of the signal generated by the photo-diode. The photo-diode, conductors, amplifier and regulator means are formed at one face of the substrate. The diode is connected between the output of the voltage regulator means and the input of the amplifier. The voltage regulator means is connected across the power conductors for providing a d.c. output voltage that is essentially a log-log function of the d.c. voltage across the power conductors, whereby any noise voltage that appears on said conductors is substantially prevented from appearing at said regulator output.

The voltage regulator means preferably consists of a current-mirror type current source being modified by having a resistor in series with the emitter of the output transistor, and of a $V_{BE}$-multiplier circuit that is connected to the current source. The regulated output voltage appears across the two series voltage-divider resistors of the $V_{BE}$-multiplier circuit. The regulator thus attenuates power line noise according to a log-log function (a logarithmof a logarithm).

The amplifier preferably has a logarithmic transfer function so that a given percentage change in light intensity at low ambient levels will produce substantially the same amplifier output signal change as would the given percentage change in light intensity at much higher ambient light levels. The output of the amplifier may be connected to a threshold detector means having a fixed threshold above which the varying components of the amplified photo-current signal must exceed before triggering the detector. When the detector is connected to an alarm signal generator means, an alarm signal is produced when the percentage change of light intensity exceeds a fixed percentage of the ambient light level independently of the absolute value of the ambient light level.

The integrated circuit of this invention is therefore particularly suitable for use as an intrusion alarm, whereby the alarm is activated when an intruder disturbs the ambient light patterns in an area under surveillance.

BRIEF DESCRIPTION OF THE DRAWING

A schematic diagram of the integrated circuit of this invention is shown, whereby the silicon integrated portions thereof are shown inside a broken line 10.

DESCRIPTION OF THE PREFERRED EMBODIMENT

In the FIGURE, the portion of the circuit diagram that is enclosed within the broken line 10 represents a silicon integrated circuit. The transistors, photo-diode, resistors, and conductors are formed at a face of a silicon substrate by standard techniques including masking, selectively doping face regions of the silicon with conductivity-altering elements as by diffusion, depositing or thermally growing a silicon oxide layer and forming aluminum conductors that overlie the oxide layer except at regions of contact to the substrate.

A modified-current-mirror circuit portion 11, consists of a reference current transistor 12, a buffer transistor 14 and an output transistor 13. The resistance of resistor 15 determines the value of current flowing in the collector of transistor 12 for a given d.c. supply voltage. The base-emitter junctions of transistors 12 and 13 have equal areas so that the emitter currents (and collector currents) of these two transistors would be essentially equal if the emitter resistor 16 had a resistance of zero (or were shorted) as is explained in the aforementioned U.S. Pat. No. 4,085,411. The existence of the resistor 16 however results in a much lower collector current in transistor 13 than in transistor 12 and further results in substantially stabilizing the collector current in transistor 13 as a function of the d.c. supply voltage which appears between buss 20 and the ground buss 21.

A $V_{BE}$-multiplier circuit portion 23 consists of an emitter-follower transistor 24, a multiplier-transistor 25 and two series-connected voltage-divider resistors 26 and 27. Other more basic $V_{BE}$-multiplier circuits are described (pg 122–123) in the tutorial text Analog Integrated Circuit Design by A. B. Grebene, Van Nostrand Reinhold Company, N.Y. A $V_{BE}$-multiplier circuit is defined herein as having a transistor connected emitter to collector in parallel with a series-resistors voltage divider network wherein the base of the transistor is connected to an intermediate point in the voltage divider network. The output voltage appearing at conductor 29 is substantially unaffected by variations in the supply voltage through the emitter follower transistor 24 and is relatively insensitive to variations in the magnitude of the current from the collector of transistor 13. The cathode of a photo-diode 30 is connected to the output conductor 29.

An amplifier circuit portion 31 has an input conductor 32 to which the anode of photo-diode 30 is connected. The backbiased photo-diode 30 generates a current that is proportional to the intensity of the light impinging upon it. This photo-current is amplified by a factor of about 70 in transistor 33 and is subsequently inverted in the current mirror circuit consisting of transistors 34, 35 and 36 wherein the base-emitter junction areas of transistors 34 and 36 are essentially equal.

The amplified photo-current that is mirrored in the collector of transistor 36 passes through the three series connected diodes 37, 38 and 39 to produce a voltage at the collector of transistor 36 and interconnected base of output transistor 40, which voltage is essentially a logarithmic function of the amplified photo-current. Transistor 40 is connected as an emitter-follower having an emitter resistor 41.

The integrated photo-diode occupies an area on the silicon substrate of 0.4 $mm^2$, has a sensitivity of 30 nano-amps/foot-candle and has a shunt capacity of about 50 pico-farads.

The block 45 represents a circuit capable of generating an electrical alarm signal at an output 46 in response to a voltage change at an input 47 which voltage change exceeds a predetermined level. An external capacitor 50 is connected between the output of the circuit 31 at terminal pad 51, and the input 47 of the alarm-signal-generator at terminal pad 52. Thus a disturbance in the light being detected by photo-diode 30 produces a change in voltage at input 47 and initiates the generation of an electrical alarm signal voltage at output 46. The capacitor 50 serves to block the transmission of d.c. voltages and signal frequencies of less than about 0.6 Hz from terminal 51 to terminal 52. Within the block 45 there is an input voltage amplifier stage (not shown) having a high frequency roll off frequency (at 3 db down) at about 9 Hz so that any 60 Hz power line currents that may be induced into any of the amplifier circuits is effectively filtered out.

The band pass of the amplifier circuits taken together is thus from 0.6 Hz to 9 Hz, so that variations of light intensity sensed by the photo-diode which lie in this low frequency range may trigger the alarm signal. The simple integrated log-log regulator (circuit 11 and 23) provides line-noise isolation at the photo-diode 30 for line noise frequencies down to 0 Hz, unlike conventional R-C filters that are characterized by a diminishing isolation efficacy toward the low end of the frequency spectrum.

The generator 45 includes an audio oscillator that is activated by a standard voltage-threshold detector circuit, which are not explicitly shown in the FIGURE. The threshold-voltage, above which the varying voltage at terminal 52 must exceed to activate the oscillator, is fixed at a predetermined value. Thus, since the voltage appearing at 51 is a logarithmic function of the intensity of light impinging on the diode 30 at any instant of time, there is a corresponding fixed percentage change of the impinging light level, namely about 5%, which will activate the oscillator for a wide range of average ambient light levels. Generator 45 also includes a timer-latch circuit that latches the oscillator on for three seconds after each activation by an initialing signal from the photo-diode. The circuit block 55 represents a power amplifier having an input 56 to which the oscillator output 46 is connected. This power amplifier derives energy from the d.c. power buss 20. The output 57 of the power amplifier 55 is connected to a terminal pad 58. The battery 60 is connected to terminal pads 61 and 62 which are in turn connected to busses 20 and 21, respectively. An electro-acoustic speaker 63 is connected to the power-signal terminal 58 and the positive d.c. supply terminal 61.

The resistor values of the circuit in the FIGURE are given in Table I below.

Table I

| Resistor | Value (ohms) |
|---|---|
| 15 | 1.6K |
| 16 | 5. K |
| 26 | 2.3K |
| 27 | 1.4K |
| 41 | 20.K |

The battery 60 is a 4.5 volt dry cell. The output current produced by the modified current-mirror circuit 11 at the collector of transistor 13 is 20 $\mu$ amp. (micro amperes).

It is readily shown that an expression for this output current $I_o$ is $$I_o = \frac{KT}{q} \frac{1}{R_{16}} \ln\left(\frac{V_{cc} - V_{BE12} - V_{BE14}}{R_{15} I_o}\right)$$

where K is Boltzman's constant, T is the absolute Kelvin temperature (300°), q is the charge of an electron, $V_{cc}$ is the power supply voltage, $V_{BE12}$ is the base-emitter voltage of transistor 12, $V_{BE14}$ is the base-emitter voltage of transistor 14, $R_{16}$ is the resistance of resistor 16, and $R_{15}$ is the resistance of resistor 15. Differentiating this expression with respect to $V_{cc}$, one obtains a noise attenuation factor $$\frac{dI_o/I_o}{dV_{cc}/V_{cc}} = \frac{KT}{q}\,\frac{1}{R_{16}}\,\frac{V_{cc}}{(I_o + \frac{KT}{q}\,\frac{1}{R_{16}})(V_{cc} - V_{BE12} - V_{BE14})} = 0.29$$

Thus the output current $I_o$ is a logarithmic function of $V_{cc}$ and when the quiescent level of $I_o$ is 20 $\mu$ amp and $V_{cc}$ is 4.5 volts any pertibations in $V_{cc}$ are attenuated by a factor of 3.5 as reflected in the output current $I_o$.

An expression for the output voltage $V_a$ from the $V_{BE}$-multiplier circuit portion 23 at conductor 29 is $$V_a \approx \frac{R_{27} + R_{26}}{R_{27}}\,\frac{KT}{q}\ln\frac{I_o}{I_{co}}$$

wherein $I_{co}$ is the reverse saturation current of transistor 25. Differentiating this expression with respect to $I_o$ one obtains $$dV_a = \frac{R_{27} + R_{26}}{R_{27}}\,\frac{KT}{q}\,\frac{dI_o}{I_o}$$

When the quiescent value of $I_o$ is 20 $\mu$ amp. and of $V_{cc}$ is 4.5 volts, the noise attenuation factor is $$\frac{dV_a/4.5\text{ volts}}{dI_o/I_o} = 0.015.$$

Thus the combined attenuation factors $0.29 \times 0.015$ is 0.0044 or 47.2 db (decibels). In other words, any noise appearing on the d.c. power buss 20 appears as a corresponding noise superimposed on the output conductor 29 but 47.2 db smaller in amplitude.

A photo-sensing integrated circuit was built and operated as described above. The noise attenuation provided by the log-log regulator was determined to be 48 db by measurements.

When $V_{cc}$ is 4.5 volts the quiescent output voltage $V_a$ is about 1.8 volts and the battery voltage may drop to as low as 2.5 volts (end-of-life) before the circuit becomes inoperable. The voltage regulator of this invention consisting of circuit portions 11 and 23, is seen to be uniquely capable of providing excellent regulation against change in $V_{cc}$ while providing a relatively high output voltage level at the diode even at abnormally low levels of $V_{cc}$.

This regulator capability in combination with a photodiode intended to detect changes in the level of light incident thereon makes possible the incorporation of an audio frequency power stage in the same silicon substrate powered from the same d.c. power supply producing noise on the common power busses that does not falsely perpetuate the alarm condition. More generally the light-change-detector of this invention is substantially immune to the presence of noise that may be produced on the d.c. power supply busses by any noise source.

What is claimed is:

1. A silicon integrated circuit for detecting changes in light intensity comprising only one photo-diode; a pair of d.c. power supply conductors; an amplifier; a voltage regulator means; and a pair of terminals for connecting to an a.c. coupling means; said photo-diode being connected between the output of said voltage regulator means and the input of said amplifier, said a.c. coupling means terminals being connected in series with the signal path through said amplifier for selectively passing only the varying components of the signal generated by said photodiode, said voltage regulator means being connected across said power conductors for providing a regulated d.c. output voltage that is essentially a log-log function of a d.c. supply voltage across said conductors whereby any noise voltage appearing on said conductors is substantially prevented from appearing at said regulator output wherefrom it may pass through the junction capacity of said photo-diode to the input of said amplifier.

2. The integrated circuit of claim 1 wherein said voltage regulator means consists of (a) a current-mirror type current source being modified by having a resistor inserted in series with the emitter of the output transistor thereof; and (b) a $V_{BE}$-multiplier circuit being connected to said current source; said regulated output voltage appearing across the series resistors voltage-divider network of said multiplier circuit.

3. The integrated circuit of claim 1 wherein said amplifier includes a circuit network for a logarithmic transfer function to produce at an output thereof a signal that is a logarithmic function of the input signal thereto.

4. The integrated circuit of claim 3 wherein said network consists of a current amplifier having at least one forward biased diode series-connected to the output of said current amplifier so that the output current from said current amplifier flows through said at least one diode and generates a voltage there-across that is a logarithmic function of said output current.

5. The integrated circuit of claim 1 additionally comprising an alarm signal generator means being electrically connected to said amplifier output for producing an electrical alarm signal in response to a signal from said output of said amplifier.

6. The integrated circuit of claim 5 additionally comprising a power amplifier having an input being connected to the output of said alarm signal generator means, said power-amplifier being connected to and energized by said power supply conductors.

7. A circuit for detecting changes in light intensity comprising a silicon integrated circuit and a discrete capacitor, said silicon integrated circuit comprising a single photo-diode; a pair of d.c. power supply conductors; an amplifier; a voltage regulator means; and a pair of terminals between which said discrete capacitor is attached, said photo-diode being connected between the output of said voltage regulator means and the input of said amplifier, said terminals being connected in series with the signal path through said amplifier for selectively passing only the varying components of the signal generated by said photo-diode, said voltage regulator means being connected across said power conductors for providing a regulated d.c. output voltage that is essentially a log-log function of a d.c. supply voltage across said conductors whereby any noise voltage appearing on said conductors is substantially prevented from appearing at said regulator output wherefrom it may pass through the junction capacity of said photo-diode to the input of said amplifier.

8. A circuit for detecting changes in light intensity comprising a silicon integrated circuit, a discrete capacitor and an electro-acoustic transducer, said silicon integrated circuit comprising a single photo-diode; a pair of d.c. power supply conductors; a photo-diode amplifier; a voltage regulator means; a pair of terminals between which said discrete capacitor is attached, said photo-diode being connected between the output of said voltage regulator means and the input of said photo-diode amplifier, said terminals being connected in series with the signal path through said photo-diode amplifier for selectively passing only the varying components of the signal generated by said photo-diode, said voltage regulator means being connected across said power conductors for providing a regulated d.c. output voltage that is essentially a log-log function of a d.c. supply voltage across said conductors whereby any noise voltage appearing on said conductors is substantially prevented from appearing at said regulator output wherefrom it may pass through the junction capacity of said photo-diode to the input of said photo-diode amplifier; an alarm-signal generator means being electrically connected through said capacitor to the output of said photo-diode amplifier for producing an electrical alarm signal in response to a signal from said photo-diode amplifier; and a power-amplifier being connected to the output of said alarm-signal generator, said electro-acoustic transducer being electrically connected to the output of said power-amplifier.

* * * * *